US007814617B2

(12) United States Patent
Frank

(10) Patent No.: US 7,814,617 B2
(45) Date of Patent: Oct. 19, 2010

(54) HINGE

(75) Inventor: Manfred Johannes Frank, Auckland (NZ)

(73) Assignee: Manfred Frank Patent Holdings Limited, Auckland (NZ)

( * ) Notice: Subject to any disclaimer, the term of this patent is extended or adjusted under 35 U.S.C. 154(b) by 454 days.

(21) Appl. No.: 11/792,402

(22) PCT Filed: Dec. 6, 2005

(86) PCT No.: PCT/NZ2005/000317

§ 371 (c)(1),
(2), (4) Date: Feb. 5, 2008

(87) PCT Pub. No.: WO2006/062415

PCT Pub. Date: Jun. 15, 2006

(65) Prior Publication Data

US 2009/0007375 A1 Jan. 8, 2009

(30) Foreign Application Priority Data

Dec. 6, 2004 (NZ) ..... 537028

(51) Int. Cl.
*E05F 1/08* (2006.01)

(52) U.S. Cl. ..... 16/286; 16/288; 16/366

(58) Field of Classification Search ..... 16/236–238, 16/240, 245–246, 286, 54, 50, 366, 367, 16/368, 370
See application file for complete search history.

(56) References Cited

U.S. PATENT DOCUMENTS 2,530,331 A * 11/1950 Hubbs ..... 16/245
2,972,788 A * 2/1961 Shean ..... 49/388
3,714,418 A 1/1973 Stephans
3,863,292 A * 2/1975 Grunert et al. ..... 16/236
4,470,170 A 9/1984 Gerteis
4,584,738 A * 4/1986 Lautenschlager ..... 16/238
4,837,894 A * 6/1989 Lin ..... 16/288
5,035,026 A * 7/1991 Carlo et al. ..... 16/288
5,074,609 A * 12/1991 Dear ..... 296/76
5,437,079 A * 8/1995 Park ..... 16/54
5,558,164 A * 9/1996 Clymer ..... 172/311
6,141,832 A 11/2000 Salice (Continued)

FOREIGN PATENT DOCUMENTS

| | | |
|---|---|---|
| AU | 295141 | 12/1966 |
| AU | 2844467 | 4/1969 |
| EP | 0705953 | 4/1996 |
| FR | 2535960 | 5/1984 |
| GB | 1049433 | 11/1966 |
| GB | 1209794 | 3/1967 |

*Primary Examiner*—Chuck Y. Mah
(74) *Attorney, Agent, or Firm*—Blakely, Sokoloff, Taylor & Zafman

(57) ABSTRACT

A hinge (10) has a first arm (14) pivotally mounted to a first mounting element (11) and a second arm (15) pivotally mounted to a second mounting element (12). The first and second arms (14, 15) intersect and are pivotally joined by a pivot (13). A first link (24) is pivotally connected to the first mounting element (11) and pivotally coupled to the second arm (15). A second link 21 is pivotally connected to the second mounting element (12) and pivotally coupled to the first arm (14). At least one of said first and second links (21, 24) is adjustable such as to adjust the position of the arm, to which the link is connected, with respect to a pivotal coupling of the mounting element to the arm. The first arm (14) is formed in two parts (31 and 32) which are pivotally coupled together whereby the angular position of one part (31) relative to the other part (32) can be altered and retained in an adjusted angular position by adjusting screws (44).

19 Claims, 10 Drawing Sheets

U.S. PATENT DOCUMENTS

| | | | | |
|---|---|---|---|---|
| 6,314,615 | B1 | 11/2001 | Wolda | |
| 6,402,270 | B1 | 6/2002 | Frank | |
| 6,487,755 | B1 | 12/2002 | Caldari | |
| 6,684,453 | B2 * | 2/2004 | Wang | 16/54 |
| 7,197,790 | B1 * | 4/2007 | Edmondson | 16/336 |
| 2001/0025398 | A1 * | 10/2001 | Zetti | 16/370 |

* cited by examiner

HINGE

This is a non-provisional application claiming the benefit of International application number PCT/NZ2005/000317 filed Dec. 6, 2005.

BACKGROUND TO THE INVENTION

This invention relates to a hinge.

In international patent specification WO 99/07260 there is disclosed a hinge, which has particular application for the hinged mounting of a glass panel. It will, however, be apparent to any person skilled in the art that the hinge has application for hinged mounting of any form of closure so that it can be moved between open and closed positions relative to an opening.

The hinge of WO 99/07260 has been particularly successful as it provides an efficient and effective solution for controlled opening and closing of a heavy glass panel or other large/heavy closure. The principal attribute of the hinge is that it is of an adjustable type. Consequently, the physical positioning of the closure relative to the opening can be adjusted with the closure still mounted on the hinges. Thus, adjustment of the closure to ensure it moves into the correct closed position as well as correctly against closely against dust seals and the like can be readily carried out.

The hinge of WO 99/07260 includes a pair or adjustable links. Use of these adjustable links enables the closure to be adjusted left or right and/or in or out relative to the plane of the opening. However, there is not provided any facility within the construction of the hinge itself for ready adjustment up and down of the closure relative to the opening.

SUMMARY OF THE INVENTION

It is therefore an object of the present invention to provide a hinge of a construction whereby there is provided an adjustment facility to effect height adjustment of a closure relative to the opening with which the closure is associated.

Broadly according to one aspect of the invention there is provided a hinge for the adjustable mounting of a closure relative to an opening, the hinge including a movable element pivotally coupled to mounting means for, in use, coupling to a closure, the movable element having a first part and a second part, the first part being pivotally coupled about a pivot axis to the second part by a pivot coupling, said pivot axis being normal to the axis of pivotal coupling of the movable element to the mounting means, and an adjustment means for fixing the first part in an adjusted angular disposition relative to the second part.

Preferably the adjustment means includes a first fixing element coupled to the second part and engaged with the first part and a second fixing element coupled to the second part and engaged with the first part substantially opposed to the engagement of the first fixing element with the first part, the first and second fixing elements being adjustably coupled to the second part.

Each of the first and second fixing elements can be a screw threaded element which is engaged in a threaded bore in the second part.

Preferably the second part has a bifurcated portion into which an end of the first part is engaged and coupled by the pivot coupling, said bifurcated portion forming a first portion with which the first fixing element is coupled and a second portion with which the second fixing element is coupled whereby the first and second fixing elements are engaged with opposite sides of the second part of the movable element.

According to a second broad aspect of the invention there is provided a hinge including a first arm adapted for pivotal mounting to a first mounting element, a second arm adapted for pivotal mounting to a second mounting element, the first and second arms intersecting and pivotally joined by pivot means, a first link adapted for pivotal connection to the first mounting element and pivotally coupled to the second arm and a second link adapted for pivotal connection to the second mounting element and pivotally coupled to the first arm, at least one of said first and second links being adjustable such as to adjust the position of the arm, to which the link is connected, with respect to a pivotal coupling of the mounting element to the arm, said first arm being formed in two arm parts which are coupled together about a pivot axis by a pivot coupling whereby the angular position of one arm part relative to the second arm part can be altered and adjustment means for retaining the first and second arm parts in an adjusted angular position.

Preferably the pivot axis is substantially normal to the pivot axis of the pivot means joining the first and second arms.

Preferably the second arm part has a first portion located adjacent one side of the second arm part and a second portion located adjacent an opposite side of the second arm part, each of said first and second portion has adjustably coupled thereto an adjustment element which is engaged with the second arm part whereby the first arm part is held in an adjusted position between the first and second portions.

Each adjustment element is preferably a threaded element engaged in a threaded bore in the second arm part. A contact end of the adjustment element is engaged with a profiled surface of the second arm part, the profiled surface being substantially at right angles to a longitudinal axis of the adjustment element.

Preferably one or both of the first and second links has a first link part adapted for pivot coupling to a said mounting element and a second link part which includes a threaded portion engaged with a correspondingly threaded portion of the first link part, said second link part being engaged with a pivot pin which pivotally couples the link to its respective arm.

Each of the arms preferably includes a bifurcated portion which pivotally carries the pivot pin and the second link part is engaged through a transverse opening through the part of the pivot pin located between opposing parts of the bifurcated portion.

Preferably the second link part is a cap screw, the head of which is located to one side of the pivot pin, the cap screw is engaged through a sleeve which extends from the other side of the pivot pin through the transverse bore to engage with the head whereby the cap screw is rotatably retained in the pivot pin.

In a preferred form the first link part includes a locking element through which the threaded portion of the second link part engages whereby the locking element retains the threaded portion in an adjusted position.

Preferably the first arm and the first link are coupled to a said first mounting element by pivot mounting arrangements whereby limited angular movement between the first mounting element and the first arm and first link is permitted.

The first mounting element can have a single opening for reception of the fastener to fasten the first mounting element to a closure.

BRIEF DESCRIPTION OF THE DRAWINGS

In the following more detailed description of a preferred embodiment of the invention, reference will be made to the accompanying drawings in which.

DETAILED DESCRIPTION OF AN EMBODIMENT OF THE INVENTION

Figure 11:
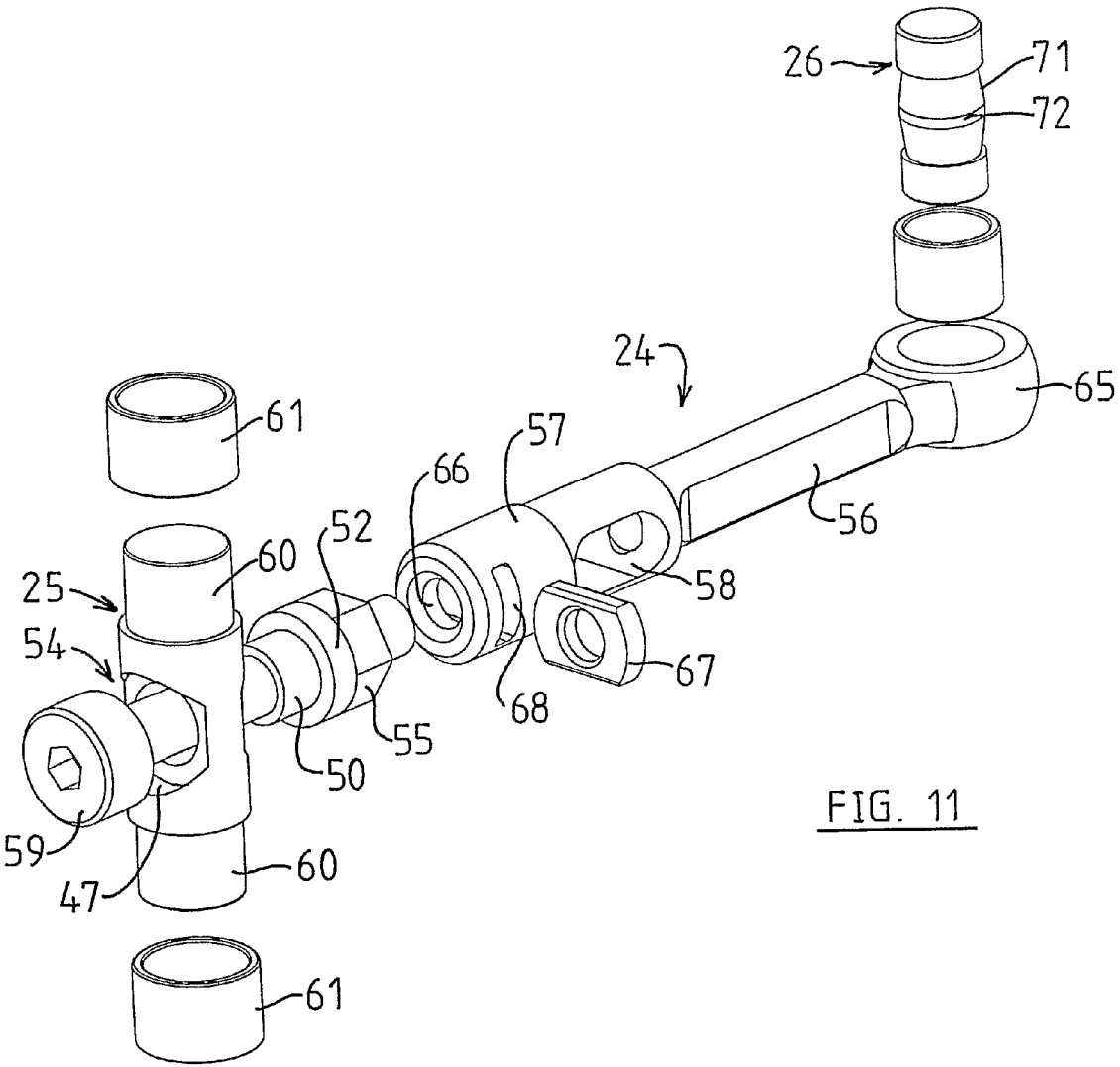
FIG. 11 is a detailed perspective exploded view of the construction of one form of the adjustable links.

Referring to FIGS. 1-5, the hinge 10 according to the present invention is shown mounted to a component F which simulates a part of a frame, wall or other fixed structural element adjacent an opening at right-angles to the plane of element F. The hinge is also shown attached to a representative element C which indicates a closure which can move from the open position as shown in FIGS. 1 to 5 through to a closed position as shown in FIG. 11.

Accordingly, in the form of the hinge 10, as illustrated, the hinge includes a closure mounting plate 11 whereby the hinge can be mounted to the closure C. Also, it has a "frame" mounting plate 12, which is mountable to the fixed structural element F.

As disclosed in international patent specification WO 99/07260 (the content of which is hereby incorporated by way of specific reference) the hinge 10 includes a main closure carrying arm 14, which intersects (e.g. preferably passes therethrough) with a second arm 15. Arms 14 and 15 are pivotally coupled together via pivot 13. The arm 14 is pivotally coupled at one end via pivot 16 to the mounting plate 11 e.g. by pair of mounting flanges 17 carried by the mounting plate 11. Likewise, one end of the second arm 15 is pivotally mounted via pivot 18 to the frame mounting plate 12 (e.g. by mounting flanges 19).

Each of arms 14 and 15 extend beyond the axis of pivot 13. Thus, arm 14 is pivotally coupled via pivot 20 to one end of an adjustable link 21. The other end of the link 21 is coupled via pivot 22 to the mounting plate 12 (e.g. by a pair of flanges 23).

In the like manner, an adjustable link 24 is mounted via pivot 25 to the second arm 15, while at its other end is mounted by pivot 26 to a flanges 27 of the mounting plate 11 (e.g. by flanges 27). As shown, flanges 17 and 27 can be formed in one part (see e.g. FIG. 1).

In one form of the hinge an end stop mechanism which is of an adjustable type can be incorporated. This provides an end stop for the hinge when in the open position.

Thus, in this form of the invention, the pivot pin 20 projects beyond the respective sides of main arm 14 and in each projecting portion there is threadingly engaged an adjusting screw. This adjusting screw can extend completely through the projecting portion such that an end thereof can come into engagement with a shaped abutment of the arm. This shaped abutment can be in the form of a ramped surface.

Consequently, the point at which the end of the stop adjusting screw will come into contact with the ramped surface abutment, depends on the extent by which the stop adjusting screw projects from the pivot pin 20.

Figure 6:
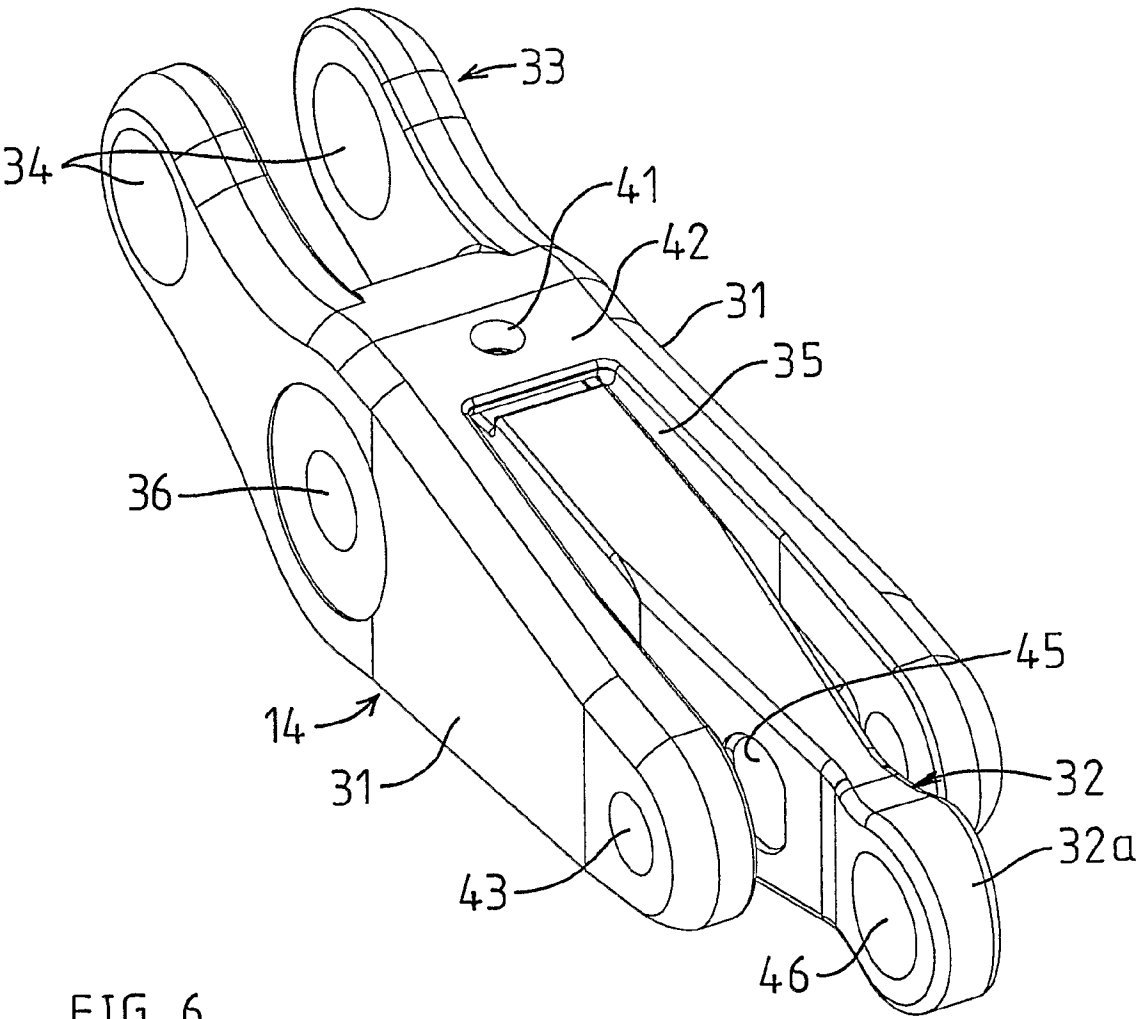
FIG. 6 is a perspective view of the main closure carrying arm of the hinge as shown in FIGS. 1-5.
Figure 7:
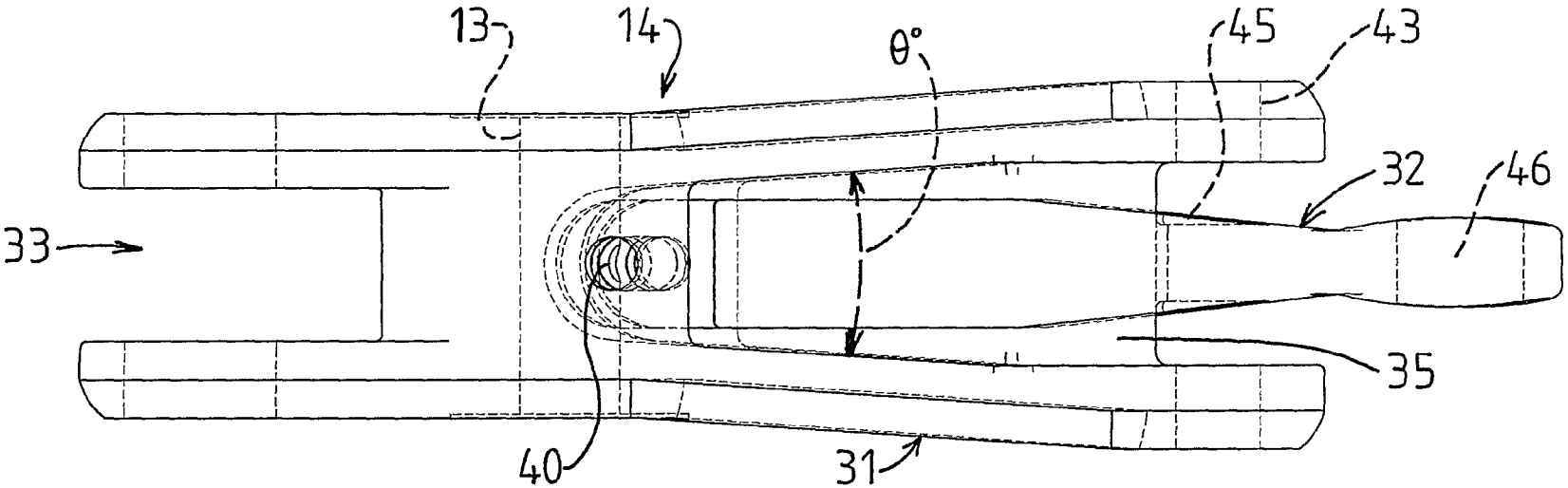
FIG. 7 is an underside view of the arm shown in FIG. 6.

The main closure carrying arm 14 is, as illustrated, formed of two components. As can be seen in FIG. 6, the main arm 14 is made up of a first component 31 into which a second component 32 is pivotally attached (as will hereinafter be described). The first arm component 31 has a bifurcated portion 33. Each leg part of bifurcated portion 33 incorporates an opening 34 through which the pivot pin 20 is engaged to couple arm 14 with link 21.

Figure 8:
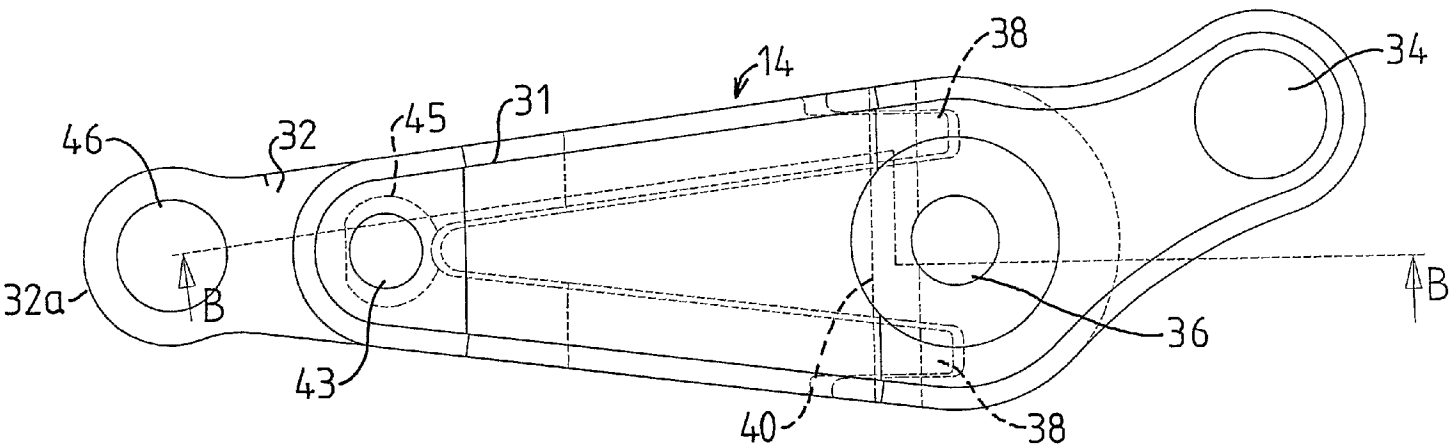
FIG. 8 is a side elevation view of the arm shown in FIG. 6.
Figure 10:
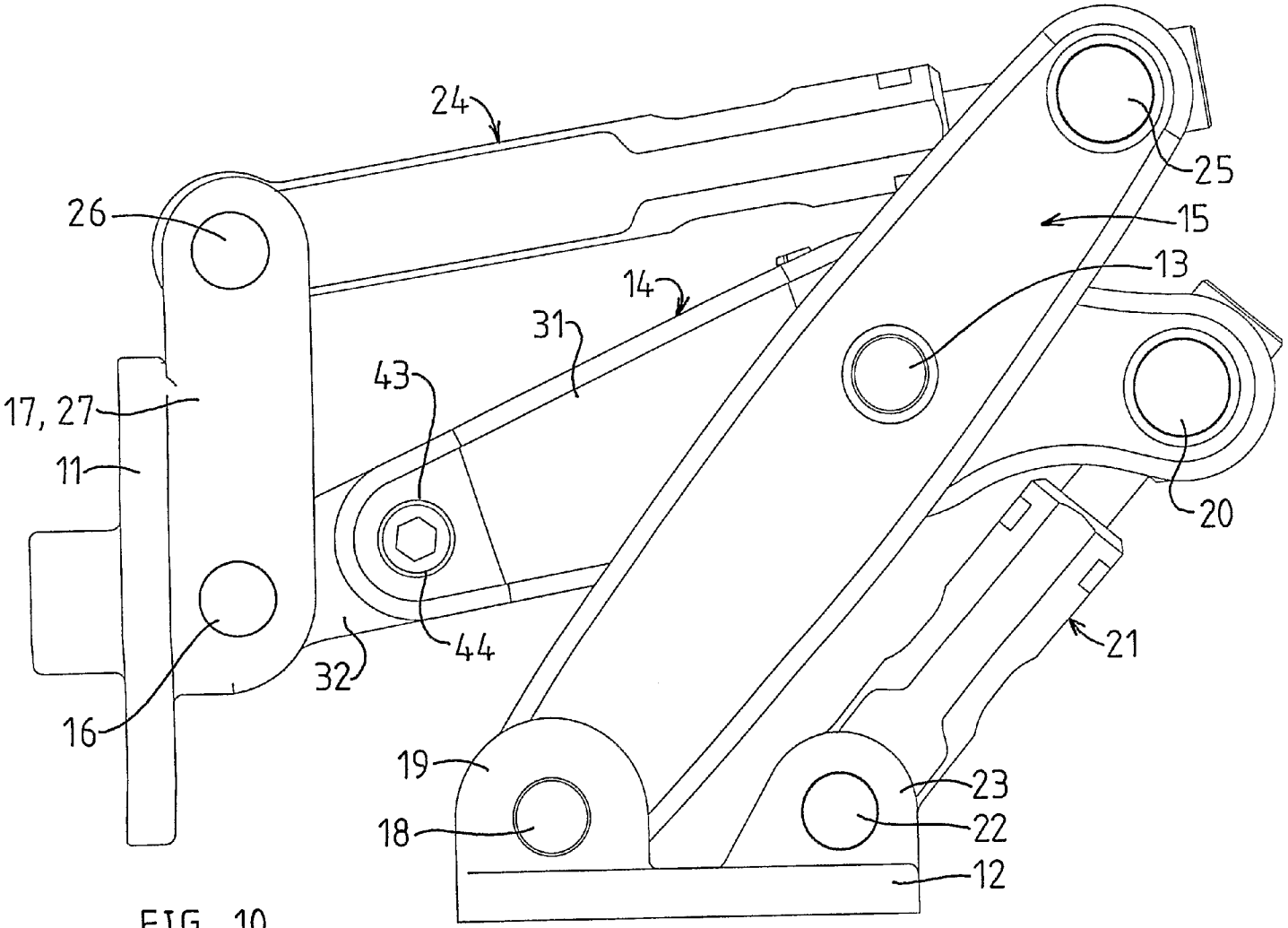
FIG. 10 is a plan view of the hinge but this time shown in the closed position.

The first arm component 31 furthermore has a hollow portion 35 into which one end of link arm 32 is engaged. A bore 36 extends through arm component 31 between opposed side walls of the arm component 31. Through this bore 36 is engaged the pivot pin of pivot 13. As can be seen in FIG. 8, the link arm 32 has a bifurcated end portion 38 so as to provide a clearance for the pivot pin 13 engaged through bore 36.

Figure 9:
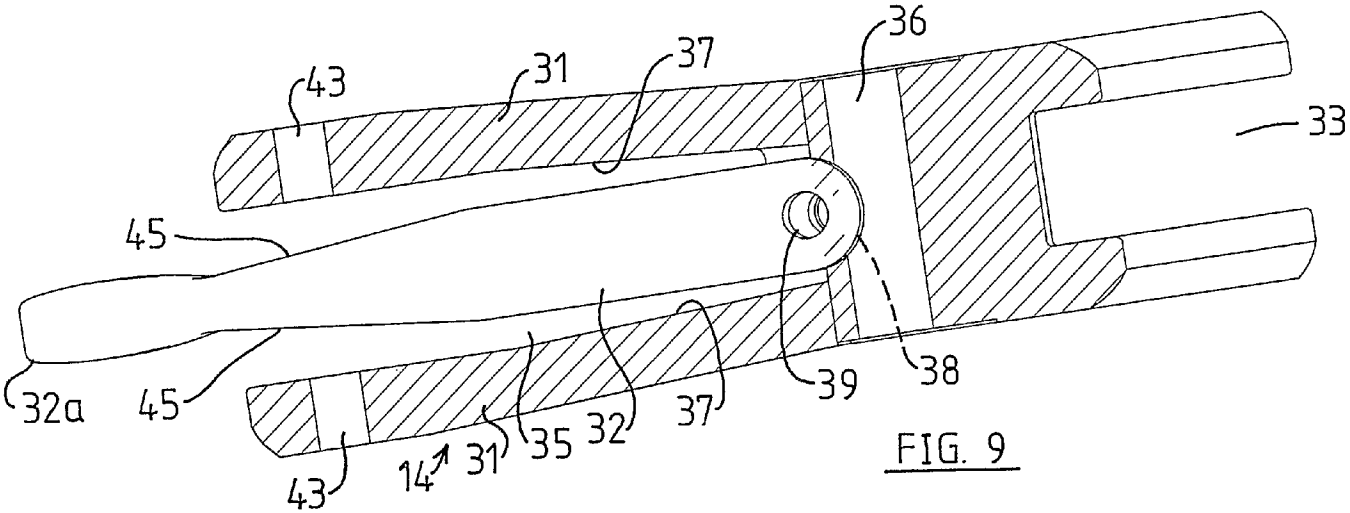
FIG. 9 is a section on line B-B of FIG. 8.

In each leg part of bifurcated portion 38 of link arm 32 there is an opening 39. Through these aligned openings 39 engages a pivot pin 40, the ends of which engage in opposed axially aligned openings 41 in opposed walls 42 of the body of the first arm component 31. As can be seen in FIG. 9, the opposed surfaces of the inside walls 37 of hollow portion 35 diverge away from the point at which the link arm 32 is pivotally coupled to the first component 31. As a result the link arm 32 can move through restricted angles of pivoting (e°) about the axis of pin 40.

Annular boss forms can be formed in each of walls 37 if required for added thickness. The bore 43 through each distal end 43 (and boss form if present) is threaded. An adjusting screw 44 is engaged therein, with the end 44*a* of the shank of the screw 44 being in contact with a profiled surface 45 of the link arm 32. There is thus an adjusting screw 44 engaged with opposed sides of the link arm 32 so as to clamp therebetween the link arm 32 and fix the link arm 32 into position whereby it cannot pivot about the axis of pivot pin 40.

Figure 2:
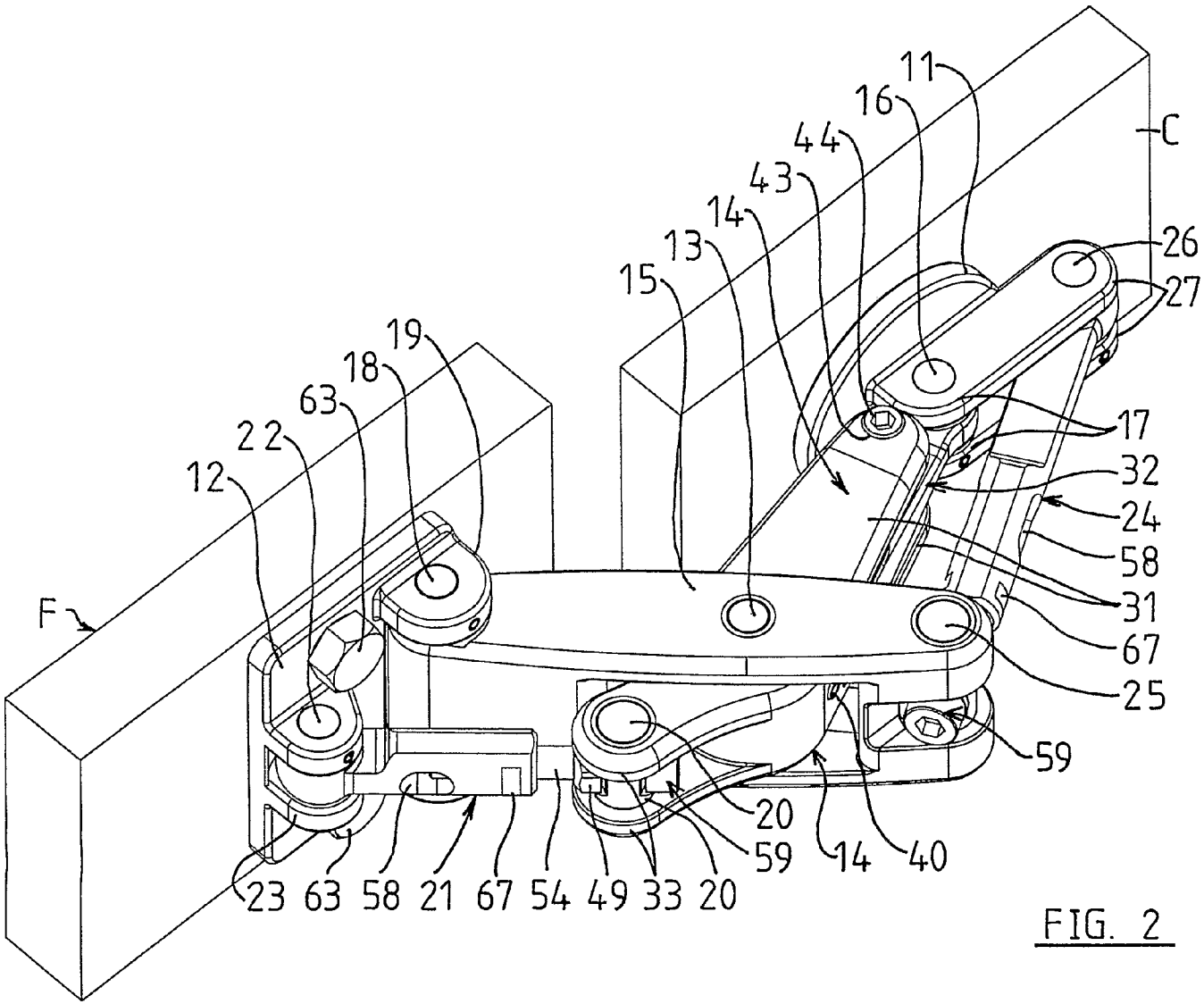
FIG. 2 is a perspective view from a different viewing position to that of FIG. 1.
Figure 3:
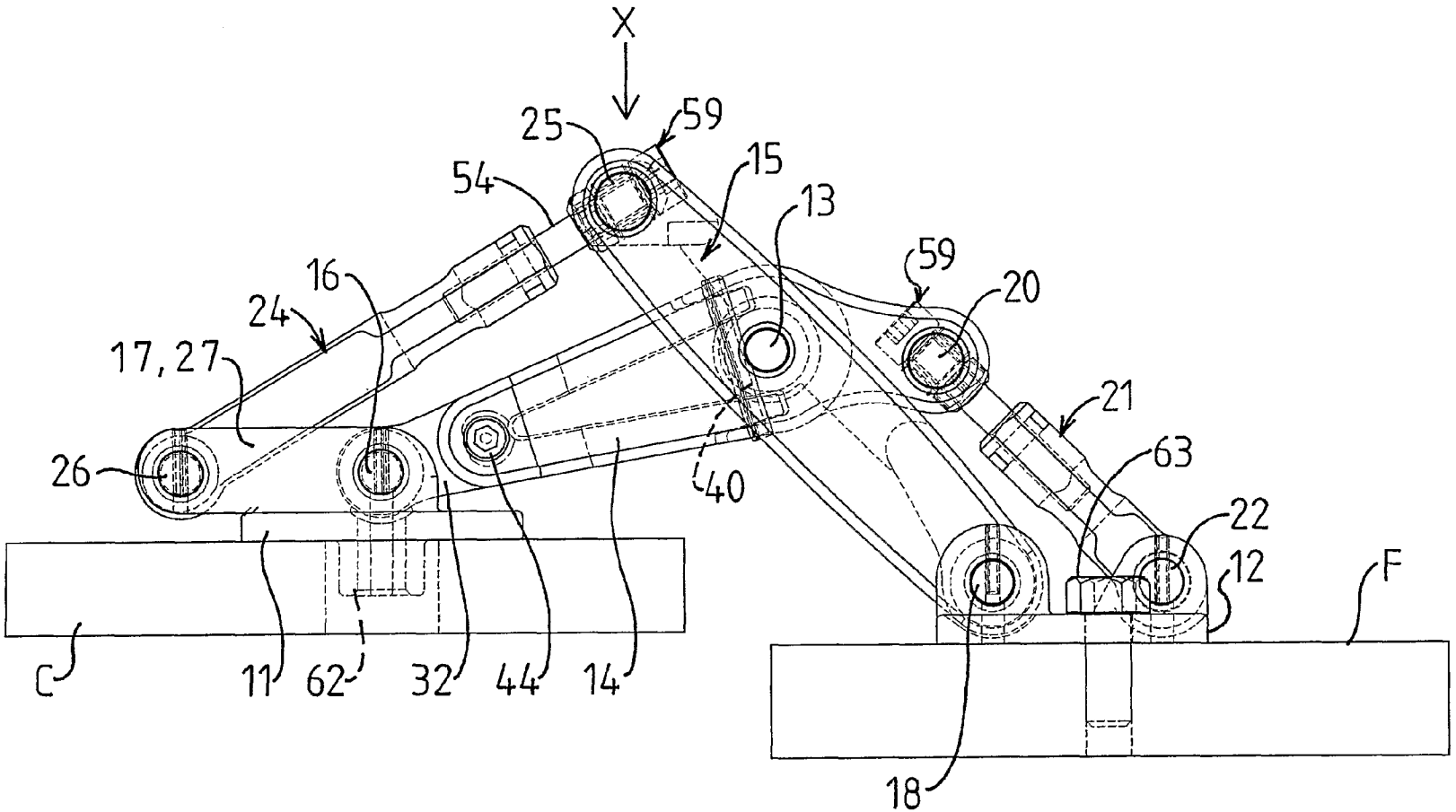
FIG. 3 is a plan view of the arrangement shown in FIG. 1.
Figure 4:
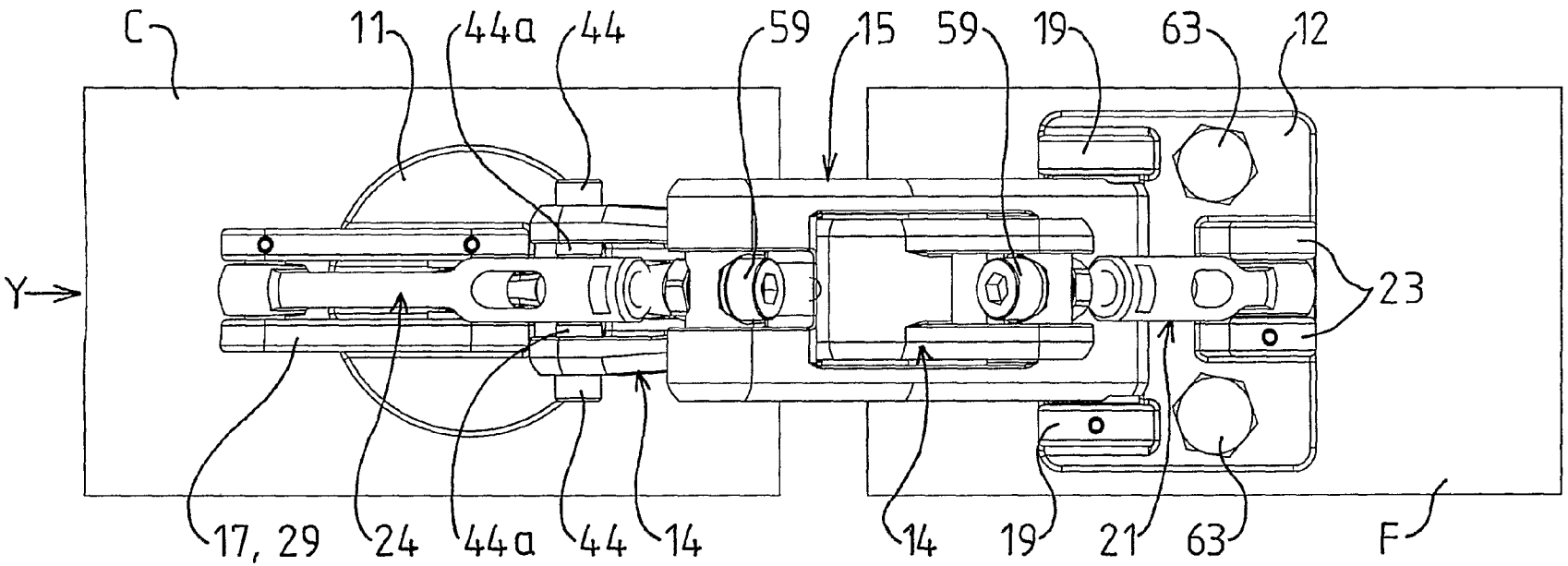
FIG. 4 is an elevation view in the direction of arrow X in FIG. 3.
Figure 5:
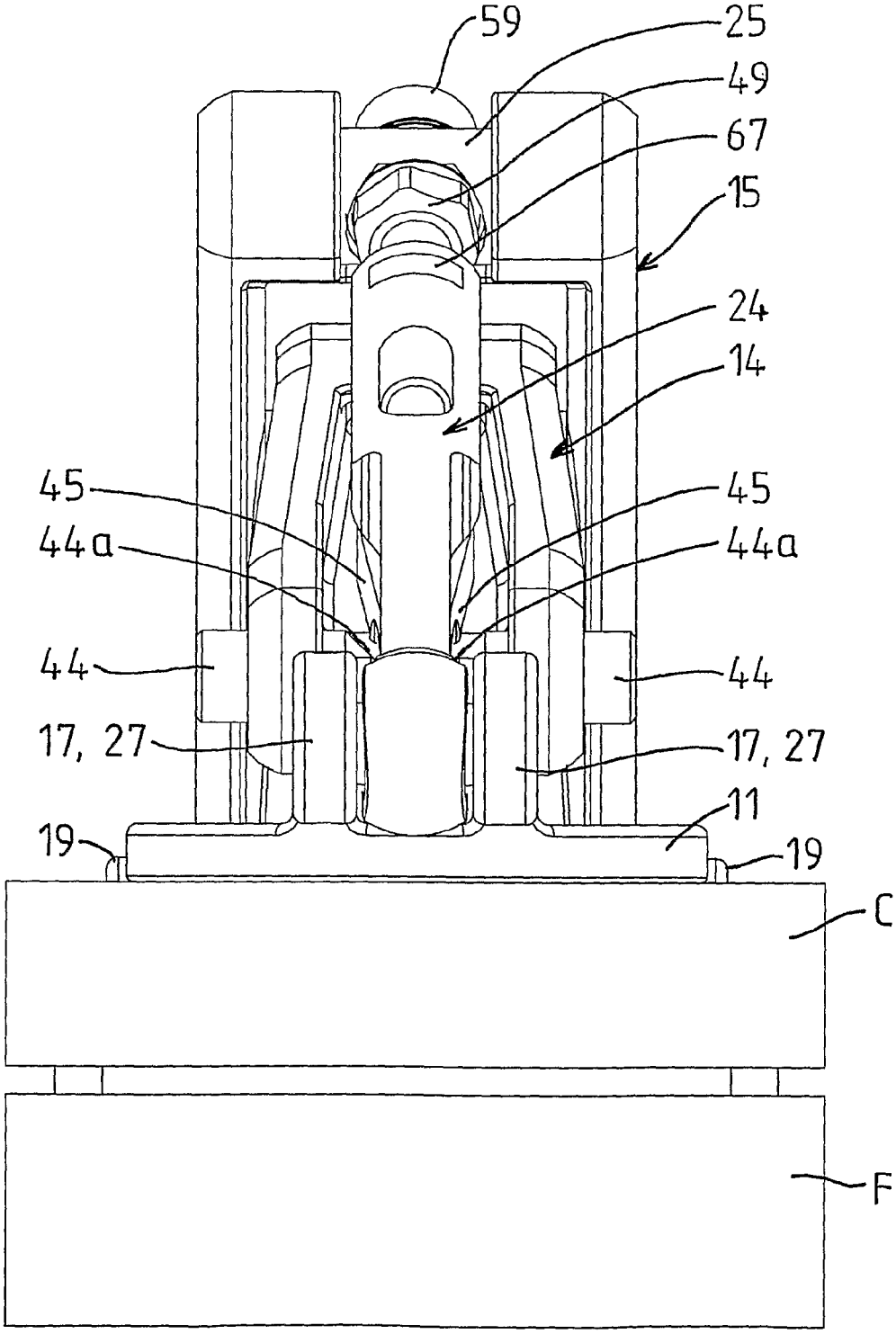
FIG. 5 is an elevation view in the direction of arrow Y in FIG. 3.

Each bore 43 can be configured to be at an angle to surface 37 of first arm component 31. This can, therefore, present the head of adjusting screw 44 at an angle whereby access, in a confined space to the head can be achieved. While the head of screw 44 is illustrated in FIG. 2 as having a hexagonal recess for an Allen key type tool equally the head could be of a protruding nature and have an external hexagonal shape for engagement with a spanner.

Not only does an annular boss enable the angled presentation of the head of adjusting screw 43 it also provides thickness for sufficient length of thread to receive the adjusting screw 44.

Each profiled surface 45 can be a faceted surface. This provides a contact surface for the end of the adjusting screw 44 and can be arranged such that the end substantially makes contact with a surface at right angles to the longitudinal axis of adjusting screw 44. The profiled surface 45 can in a second (an illustrated form) be a recessed area 45 in arm 32 as illustrated. This can be arranged to be at substantially right angles to the axis of screw 44.

The distal end 32*a* of link arm 32 has an opening 46 through which is engaged the pivot pin 16 linking the arm 14 to the pair of flanges 17 of mounting plate 11.

Figure 1:
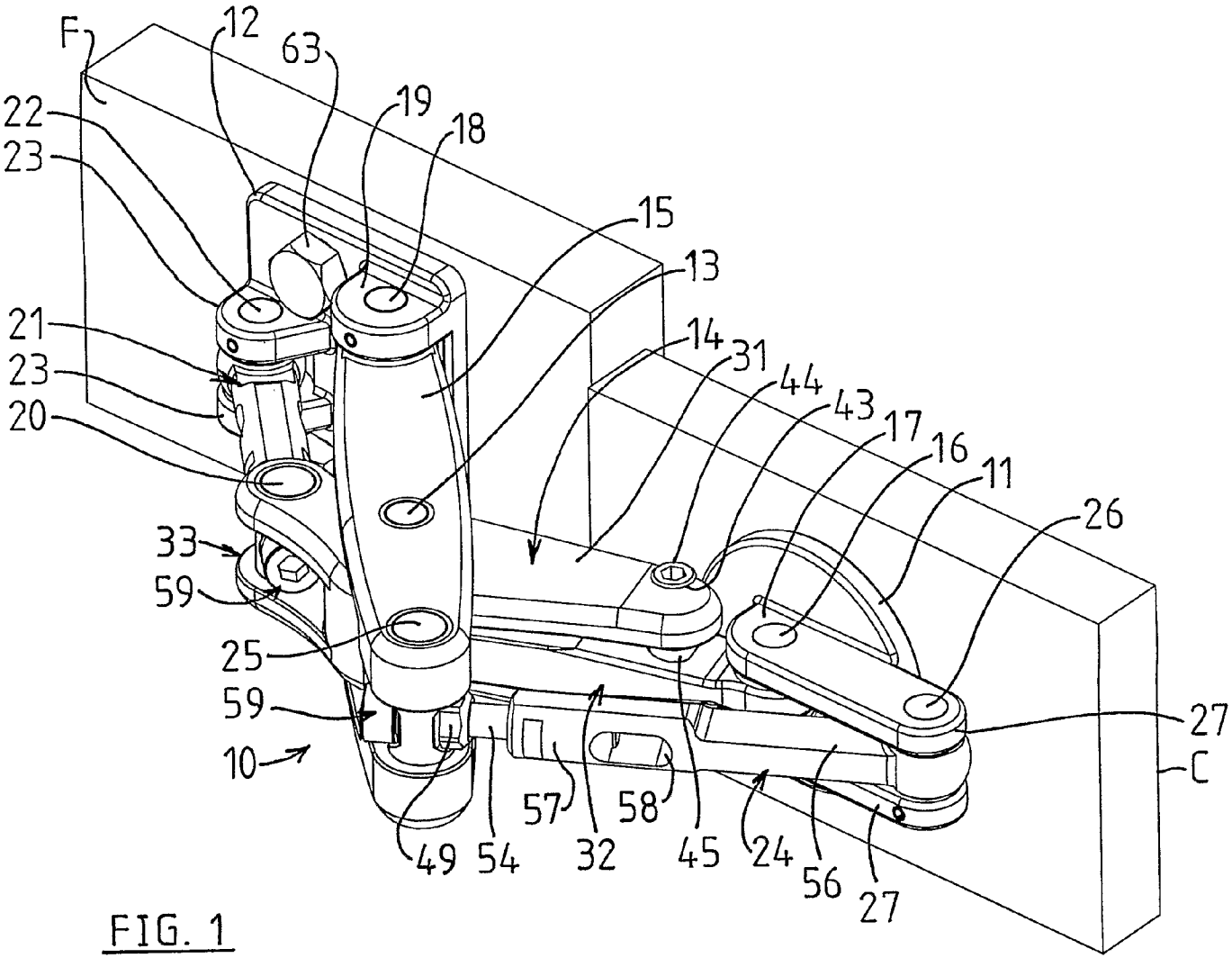
FIG. 1 is a perspective view of a hinge according to the present invention, the hinge being shown in a fully open position of a closure relative to an opening.

Referring therefore to FIGS. 1 and 2, it will be appreciated that by adjusting the pair of height adjusting screws 44, the annular position of the link arm 32 relative to the arm component 31 can be adjusted. Effectively, this moves the link arm 32 up or down relative to arm component 31 and consequently raises or lowers the position of closure C. It will be appreciated that a closure C will be mounted by a pair of hinges, thus, such adjustment is made at each hinge.

As with the hinge described in WO 99/07260, the adjustable links 21 and 24 are of a type whereby the distance between the pivots linked by the adjustable link an be altered. Thus, in the arrangement described in WO 99/07260, a simple turn buckle arrangement with rose joints can be employed such that the effective length of the turn buckle can be adjusted to thereby adjust the distance between the pivot axes.

According to the present invention and as shown in FIG. 11, the pivot pin (e.g. pivot pin 25) is waisted in its length so as provide recesses 47 and 48 in opposed sides of the pivot pin. A flanged sleeve 49 is provided, the sleeve portion 50 being dimensioned so as to be engageable in opening 51 in the pivot pin 25. As a result the flange 52 can engage in the recess 48.

A cap screw 54 engages through opening 51 and is threadingly engaged through flanged sleeve 49 to project from the other side (i.e. beyond a hex form 55) to a distal end 54*a*.

The link 24 has an elongate portion 56, one end of which has an annular mounting section 65, which engages between flanges 27 and is captured by pivot pin 26. At the distal end of the elongate portion 56 there is an enlarged portion 57 and into which the exposed threaded end 54*a* of cap screw 54 can engage. An opening 58 is formed in this enlarged end.

The pivot pin 25, cap screw 54 and flanged sleeve 49 are assembled by the cap screw 54 being threaded into sleeve 49 until the end of the sleeve 50 engages the underside of head 59. The length of sleeve 49 is such when the head 59 and sleeve 49 are tightly engaged the sleeve 49 can nevertheless still rotate in bore 51. The cap screw 54 is thus fastened to pivot pin 25 but can rotate.

The cap screw 54 can thus be rotated so as to thread end 54*a* further into or out of the threaded bore 66 of link member 56, thereby shortening or lengthening (respectively) the effective length of the link 24. Once the link 24 has been adjusted to its required length, it will stay in such adjusted position because the end 54*a* will have passed through a nylon (or other suitable plastic material) locking element 67 located in transverse passage 68. Element 67 has an opening 69 through which the end 54*a* threadingly engages. The open area 58 provides a visual indication that the threaded end 54*a* is through the locking element 67.

As shown in FIG. 11, each end of the pivot pin 25 has a reduced diameter portion 60. Engaged on each reduced diameter end 60 is a sleeve 61. The sleeve 61 engages in the opening formed in the arm 15 and through which the relevant pivot pin 25 is engaged. This is a similar arrangement to that disclosed in WO 99/07260.

Engaged in annular mounting section 65 is a sleeve 70. As can be seen in FIG. 12 the pivot pin 26 has a profiled central portion 71 which provides a centrally disposed surface 72. The sleeve 70 (in the assembled joint) rides on this surface 72 but can rock to either side depending on the angle at which the link member 56 is disposed to the central longitudinal axis of pivot pin 26. Thus the coupling of link 24 to the pivot pin 26 can self align as height adjustment is carried out as described herein.

In the illustrated form of the invention, the closure mounting plate 11 is shown to be of circular form, this being achievable because of the relative closeness of pivots 16 and 26, these being closer together than the pivots shown in WO 99/07260 due to the different geometry of the hinge according to the present invention. Provision can be made for a single fastener to engage through the closure C and into a boss form of the mounting plate 11.

The mounting plate 12 for mounting to the frame F is of more elongate form and has provision for two mechanical fasteners 63 to fasten the plate 12 to the frame F.

The hinge according to the present invention thus provides means via adjustable links 21 and 24 to adjust the position of closure C relative to the opening in either left and right directions in and out directions. However, the height adjusting screws 44 provide a ready means of providing up and down adjustment of the closure C relative to the opening. Therefore, in a very simple yet effective manner, straightforward adjustments on the hinge itself can provide full adjustment of the position of the closure C relative to the opening.

The invention is open to modification as will be appreciated by those skilled in the art. For example, in place of the mounting plates 11 and 12, extrusions, more particularly channel shaped extrusions, could be used. The position of the flanges of such extrusions would be chosen to function as the mounting flanges for pivot pins 16, 18, 22 and 26. In the case of pivot pin 22, spacer or packers would be required to accommodate the wider spacing of the walls of the channel section compared to the pair of flanges 23 as shown in the illustrated embodiment.

It is envisaged that the hinge components can be made of stainless steel, die-cast aluminium or plastic or combinations thereof.

Other modifications within the scope of the invention will be apparent to those skilled in the art.

The invention claimed is:

1. A hinge for the adjustable mounting of a closure relative to an opening, the hinge including a movable element pivotally coupled to mounting means for, in use coupling to a closure, and a fixed element coupled to a second mounting means for, in use coupling to a frame, said opening being formed by movement of said closure relative to said frame, the movable element having a first part and a second part, the first part being pivotally coupled about a pivot axis to the second part by a pivot coupling, said pivot axis being normal to the axis of pivotal coupling of the movable element to the mounting means, and an adjustment means for fixing the first part in an adjusted angular disposition relative to the second part.

2. A hinge as claimed in claim 1 wherein the adjustment means includes a first fixing element coupled to the second part and engaged with the first part and a second fixing element coupled to the second part and engaged with the first part substantially opposed to the engagement of the first fixing element with the first part, the first and second fixing elements being movably coupled to the second part.

3. A hinge as claimed in claim 2 wherein each of the first and second fixing elements is a screw threaded element which is engaged in a threaded bore in the second part.

4. A hinge as claimed in claim 2 or 3 wherein the second part has a bifurcated portion into which an end of the first part is engaged and coupled by the pivot coupling, said bifurcated portion forming a first portion with which the first fixing element is coupled and a second portion with which the second fixing element is coupled whereby the first and second fixing elements are engaged with opposite sides of the second part of the movable element.

5. A hinge as claimed in claim 4 wherein the first part of the movable element include on each of said opposite sides a profiled portion, each profiled portion being positioned to be engaged by a respective one of the fixing elements.

6. A hinge including a first arm pivotally mounted to a first mounting element, a second arm pivotally mounted to a second mounting element, the first and second arms intersecting and pivotally joined by pivot means, a first link adapted for pivotal connection to the first mounting element and pivotally coupled to the second arm and a second link adapted for pivotal connection to the second mounting element and pivotally coupled to the first arm, at least one of said first and second links being adjustable such as to adjust the position of the arm, to which the link is connected, with respect to a pivotal coupling of the mounting element to the arm, said first arm being formed in two arm parts which are coupled together about a pivot axis by a pivot coupling whereby the angular position of one arm part relative to the second arm part can be altered and adjustment means for retaining the first and second arm parts in an adjusted angular position.

7. A hinge as claimed in claim 6 wherein the pivot axis is substantially normal to the pivot axis of the pivot means joining the first and second arms.

8. A hinge as claimed in claim 7 wherein the second arm part has a first portion located adjacent one side of the second arm part and a second portion located adjacent an opposite side of the second arm part, each of said first and second portion has adjustably coupled thereto an adjustment element which is engaged with the second arm part whereby the first arm part is held in an adjusted position between the first and second portions.

9. A hinge as claimed in claim 8 wherein each adjustment element is a threaded element engaged in a threaded bore in the second arm part.

10. A hinge as claimed in claim 9, wherein the threaded bore is formed in part in a protruding annular boss form in the second arm part.

11. A hinge as claimed in claim 8 wherein a contact end of the adjustment element is engaged with a profiled surface of the second arm part, the profiled surface being substantially at right angles to a longitudinal axis of the adjustment element.

12. A hinge as claimed in claim 11 wherein the adjustment element has a shaped recess for engagement by a tool to facilitate rotation of the adjustment element.

13. A hinge as claimed in claim 12, wherein one or both of the first and second links has a first link part adapted for pivot coupling to a said mounting element and a second link part which includes a threaded portion engaged with a correspondingly threaded portion of the first link part, said second link part being engaged with a pivot pin which pivotally couples the link to its respective arm.

14. A hinge as claimed in claim 13 wherein each of the arms includes a bifurcated portion which pivotally carries the pivot pin and the second link part is engaged through a transverse opening through the part of the pivot pin located between opposing parts of the bifurcated portion.

15. A hinge as claimed in claim 14 wherein the second link part is a cap screw, the head of which is located to one side of the pivot pin, the cap screw is engaged through a sleeve which extends from the other side of the pivot pin through the transverse bore to engage with the head whereby the cap screw is rotatably retained in the pivot pin.

16. A hinge as claimed in claim 15 wherein the first link part includes a locking element through which the threaded portion of the second link part engages whereby the locking element retains the threaded portion in an adjusted position.

17. A hinge as claimed in claim 16 wherein the first arm and the first link are coupled to a said first mounting element by pivot mounting arrangements whereby limited angular movement between the first mounting element and the first arm and first link is permitted.

18. A hinge as claimed in claim 17 wherein the first mounting element has a single opening for reception of the fastener to fasten the first mounting element to a closure.

19. A hinge as claimed in claim 18 wherein the first arm and first link are coupled to the first mounting element closely adjacent to the single opening.

* * * * *